US005980154A

United States Patent [19]

Record

[11] Patent Number: 5,980,154

[45] Date of Patent: Nov. 9, 1999

[54] MANUAL SCREEDING SYSTEM

[76] Inventor: Darren D. Record, 10635 W. Solano Dr., Glendale, Ariz. 85307

[21] Appl. No.: 09/036,949

[22] Filed: Mar. 9, 1998

[51] Int. Cl.[6] ..... E01C 19/22

[52] U.S. Cl. ..... 404/97; 404/118; 425/458; 425/472

[58] Field of Search ..... 404/97, 118, 119; 425/458, 470, 472

[56] References Cited

U.S. PATENT DOCUMENTS

| | | | |
|---|---|---|---|
| 2,897,735 | 8/1959 | Alessio | 404/118 |
| 4,449,845 | 5/1984 | Carrillo | 404/118 |
| 4,641,995 | 2/1987 | Owens | 404/118 |
| 4,828,427 | 5/1989 | Nisenbaum | 404/118 |
| 5,244,305 | 9/1993 | Lindley | 404/97 |
| 5,368,465 | 11/1994 | Wanderer | 425/187 |

*Primary Examiner*—James P. Mackey
*Attorney, Agent, or Firm*—Martin L. Stoneman

[57] ABSTRACT

A manual screeding system for use in leveling freshly poured concrete which includes a frame for providing structural integrity to the screed. The screeding system includes handles, attached to the frame, for manually holding and manipulating the screeding system during the screeding process. A support, attached to the frame, is provided for preventing the screeding system from rotating about the handles during the screeding process. The support is structured to engage the forearms of the user when the screeding system is in use. A pair of bracket assemblies are provided for securely holding a screed board to the frame.

20 Claims, 2 Drawing Sheets

FIG. 2
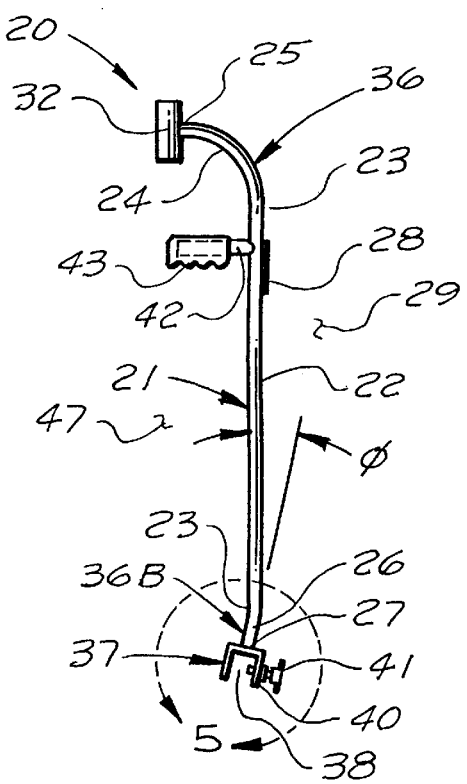
FIG. 3
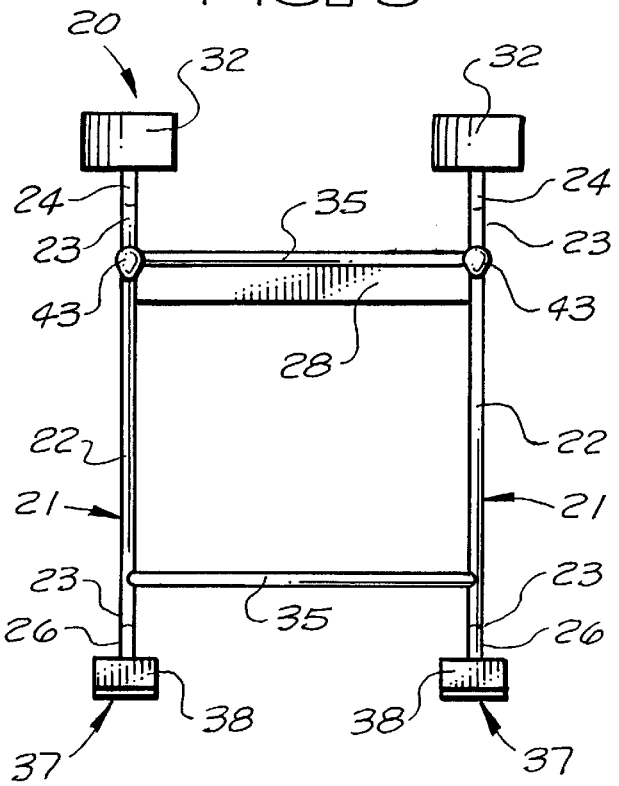
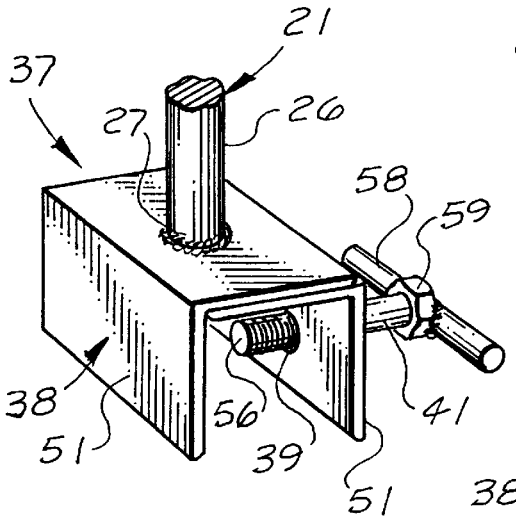
FIG. 6
FIG. 5
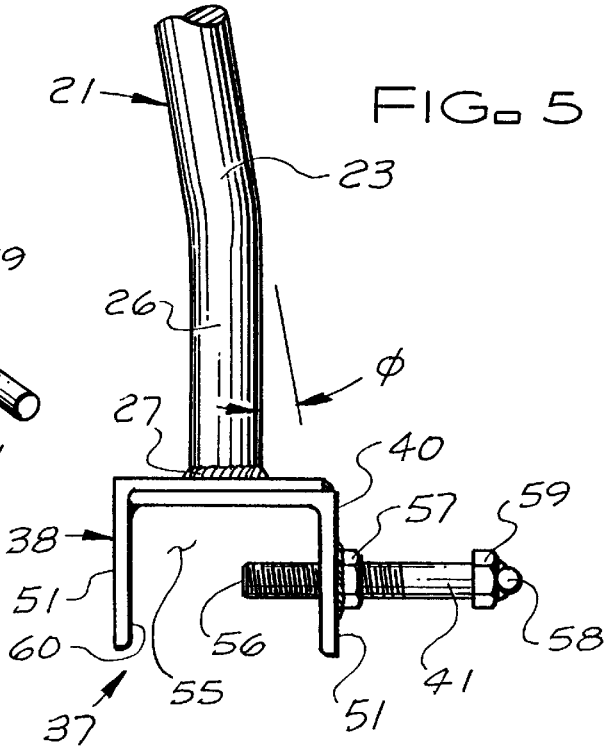

MANUAL SCREEDING SYSTEM

BACKGROUND OF THE INVENTION

1. Field of the Invention

This invention relates to a manual screeding system. More particularly, this invention concerns a manual screeding system for use in leveling freshly poured concrete and which can be manipulated and supported by the hands and arms of a single user.

2. Description of the Prior Art

Typically, after concrete is poured it must be leveled in order to provide a concrete surface that is relatively even and smooth. To provide the aforementioned smooth surface, screed boards are used. They normally are wooden boards of the two-by-four or two-by-six type and having a longitudinal length sufficient to level an area equal to the size of the concrete pour. The screed board is typically operated by having two individuals grasp the ends of the screed board and drag the screed across the concrete pour while maintaining the screed ends flush against the top of the form boards or screed guides.

A variety of screed systems have been developed in an attempt to make the screeding process easier. For example, U.S. Pat. Nos. 5,016,319 and 4,256,416 disclose screed systems comprising handle-like structures which are attached adjacent to each end of the screed board. Though such systems may be adequate for their intended uses, neither system teaches a screed system which may be used by a single operator.

Screed systems which require only a single operator are disclosed in U.S. Pat. Nos. 4,591,291 and 4,449,845. In particular, U.S. Pat. No. 4,591,291 teaches a screeding system for use by a single operator which incorporates the use of an electrically powered screed vibrator and counterweights. Though such a system may be adequate for larger concrete pours, it may be too cumbersome and costly for many simple concrete leveling applications. U.S. Pat. No. 4,449,845 also teaches a screeding system for use by a single operator incorporating the use of a harness arrangement and having extended handles spaced a fixed distance apart to accommodate the user's torso therebetween. Such an arrangement may be suitable for operators having a small or medium build but would be impracticable and inconvenient for those with larger torsos who may not be able to fit within the handles. Thus, it is believed by the applicant that none of the prior art referred to herein will accomplish the purpose of the present invention.

OBJECTS OF THE INVENTION

A primary object of the present invention is to fulfill the above-mentioned need by the provision of a manual screeding system. A further primary object of the present invention is to provide such a system which is efficient, easy to use, easy to manufacture, inexpensive, and handy. Other objects of this invention will become apparent with reference to the following invention descriptions.

SUMMARY OF THE INVENTION

According to a preferred embodiment of the present invention, this invention provides a manual screeding system, for use with a concrete screed, operable by a single user and held and supported by the user's hands and forearms, comprising in combination: frame means for providing structural integrity to such screed, holding means, rigidly attached to a lower portion of such frame means, for holding a screed board; gripping means, rigidly attached to an upper portion of such frame means, for being grasped by a user's hand; and support means, rigidly attached to an upper portion of such frame means, for being supported by a user's forearm when such user is grasping such gripping means; structured and arranged in such manner that such user may control a pulling of such screed over concrete.

In addition, this invention provides such a manual screeding system wherein such support means comprises means for supporting such screeding system from rotation about such gripping means during screeding. This invention further provides such a system wherein such support means comprises a pair of curved cuffs, each such curved cuff being structured and arranged, respectively, to overlay a respective one of such user's forearms; and, further, wherein such curved cuffs are sized and curved in such manner as to engage such forearms of such user. And, it further provides such a system wherein such curved cuffs further comprise a padding material.

Additionally, it provides for such a manual screeding system wherein such gripping means comprises a pair of handles; also, it provides such a system wherein each such handle comprises a substantially straight bar member. And, further, it provides such a manual screeding system wherein such frame means comprises an upwardly-convex curved top portion and wherein such forearm support means is attached to such curved top portion. And it provides such a manual screeding system further comprising angle means for normally maintaining such frame means at an angle of about ten degrees toward such user from vertical. And, still further, it provides such a manual screeding system wherein: such forearm support means comprises a pair of curved cuffs, each such curved cuff being structured and arranged, respectively, to overlay a respective one of such user's forearms; such gripping means comprises a pair of handles; such frame means comprises an upwardly-convex curved top portion; and such forearm support means is attached to such curved top portion.

Even further, in accordance with a preferred embodiment thereof, this invention provides for a manual screeding system for use with a screed board, operable by a single user, having a user side and an exterior side, and held and supported by the user's hands and forearms, comprising in combination: a pair of substantially vertical frame bars each having an intermediate substantially straight portion, having an upper end, an upwardly-convex curved top portion, curving toward the user side from such upper end of such straight portion, and having a user-side end portion, and a bottom portion, angled toward the user side, having a bottom end; a first substantially horizontal frame bar, attached to each of such substantially vertical frame bars; a second substantially horizontal frame bar, spaced apart from such first substantially horizontal frame bar and attached to each of such substantially vertical frame bars; a gripping means, attached to each such upper end of each such straight portion, for manually holding and manipulating such screeding system during screeding; a holding means, attached to such bottom end of such bottom portion, for holding such screed board to such screeding system; and a support means, attached to each such user-side end portion, for supporting such screeding system from rotation about such gripping means during screeding.

In addition, this invention provides for such a manual screeding system wherein such bottom portion is angled toward the such user side at an angle of about ten degrees. And it provides such a system wherein such holding means comprises a pair of brackets, each such bracket having a substantially open interior portion structured and arranged for receipt of such screed board; and, further, wherein such holding means further comprises a compressive means for compressively holding such screed board within such respective open interior portions of such brackets. Also, it provides such a manual screeding system wherein such compressive means comprises a threaded bolt.

Additionally, the present invention provides for such a manual screeding system wherein each such support means comprises a curved cuff structured and arranged for overlaying a user's forearm. And, further, it provides a manual screeding system wherein: such holding means comprises a pair of brackets, each such bracket having a substantially open interior portion structured and arranged for receipt of such screed board; and each such gripping means comprises a pair of substantially straight, substantially horizontal, bar members. Yet even further, it provides for a manual screeding system wherein: each such curved cuffs further comprises a padding material; and, further still, wherein each such bar member is covered with a bicycle-handle-type grip. And it provides such a manual screeding system wherein each such gripping means comprises a pair of substantially straight, substantially horizontal, bar members.

BRIEF DESCRIPTION OF THE DRAWINGS

FIG. 2 is a left side elevation view of the present invention.

FIG. 3 is a back side elevation view of the present invention.

FIG. 5 is a partial left side elevation view illustrating in enlarged detail the screed board bracket assembly.

FIG. 6 is a rear perspective view of the screed board bracket assembly.

DETAILED DESCRIPTION OF A PREFERRED EMBODIMENT AND THE BEST MODE OF PRACTICE

Figure 1:
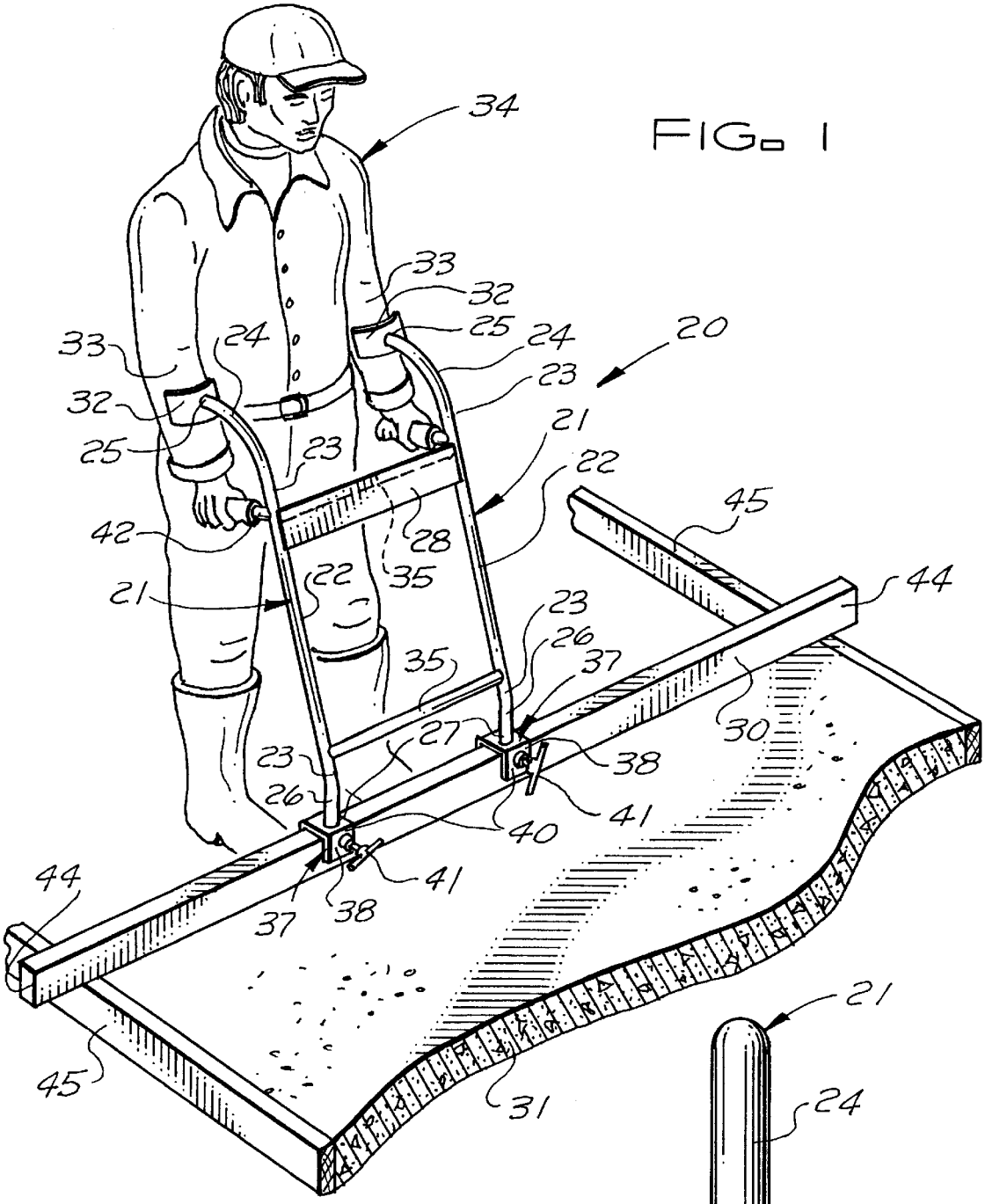
FIG. 1 is a perspective view of the preferred embodiment of the manual screeding system of the present invention in its use environment.

Shown in perspective in FIG. 1 is the manual screeding system 20 of the present invention in use in its working environment. The manual screeding system 20 includes a pair of substantially vertical frame bars 21, preferably made of 1 inch steel tubing. As shown, each of the vertical frame bars 21 comprises an intermediate substantially straight portion 22 having a pair of straight portion ends 23, an integral curved top portion 24 having a top end 25, and an integral slanted bottom portion 26 having a bottom end 27. Also shown in FIGS. 1 through 3 is the use of a logo plate 28 integrally attached, preferably by welding, to the exterior side 29 of the manual screeding system 20 as shown best in FIG. 2. In the preferred embodiment of the present invention, logo plate 28 is preferably substantially rectangular in shape having approximate dimensions of 4 inches by 2 feet and is preferably made of 1/16-inch-thick steel.

The screed board 30, such as the one shown in FIG. 1, is typically a wooden board of the two-by-four or two-by-six type. The length of screed board 30 is selected to accommodate the size of the concrete pour 31 to be leveled. Do to the typically heavy weight associated with freshly laid concrete pour 31 and the fact that the manual screeding system 20 is structured to be used by a single operator 34, the preferred length of screed board 30 is approximately up to no more than 16 feet. To provide a reactionary force against the weight of the concrete pour 31 acting against the screed board 30, the preferred embodiment of the present invention is provided with a pair of curved cuffs 32 integrally attached, preferably by welding, to each top end 25 of each curved top portion 24. Each of the curved cuffs 32 are structured and arranged to engage the operator's forearms 33 (as shown in FIG. 1) when the manual screeding system 20 is in use. This arrangement effectively prevents any outward rotation of the manual screeding system 20 at the screed board connection due to the weight of the concrete pour 31 acting against the screed board 30. Specific details with respect to the preferred construction and arrangement of the curved cuffs 32 will be discussed hereinafter with respect to FIG. 4.

As shown in FIGS. 1 and 3, connecting bars 35 are used to connect each of the substantially vertical frame bars 21 and thus create a rigid frame-like structure. The connecting bars 35 are preferably made of 1 inch steel tubing and are integrally attached, preferable by welding, adjacent to the straight portion ends 23 of each substantially straight portion 22. This arrangement embodies in this invention a frame means for providing structural integrity to such screed. As shown in FIG. 2, the frame means further comprises an upper portion 36 and a lower portion 36B. Also illustrated in FIG. 1 is a screed board bracket assembly 37 integrally attached, preferably by welding, to each bottom end 27 of each slanted bottom portion 26. Each screed board bracket assembly 37 comprises a screed board bracket 38 having a through hole 39 (as shown in FIG. 6) in front surface 40 to allow passage of each of the tightening bolts 41. Screed board bracket assembly 37 embodies herein a holding means, rigidly attached to a lower portion of such frame means, for holding a screed board. Specific details with respect to the preferred construction and arrangement of each screed board bracket assembly 37 will be discussed hereinafter with respect to FIGS. 5 and 6.

To facilitate handling and maneuvering of the manual screeding system 20, handles 42, preferably made of 1 inch steel tubing, are provided. As shown in FIGS. 1 and 2, the handles 42 are integrally attached, preferable by welding, adjacent to the straight portion ends 23 of each substantially straight portion 22. Handles 42 extend outwardly from, and substantially perpendicular to, each substantially straight portion 22 and have a preferred length of approximately five inches. Handles 42 embody herein a gripping means, rigidly attached to an upper portion of such frame means, for being grasped by a user's hand. Each of the handles 42 may also be provided with a grip-type material or handle grips 43, preferably a bicycle-handle-type grip, to improve the grip of the operator 34 and to prevent hand slippage.

In operation, the operator 34 of the manual screeding system 20 grasps handles 42 and tilts the upper portion 36 of the manual screeding system 20 toward the operator 34 until curved cuffs 32 rest against the operator's forearms 33. In this position, the slanted bottom portion 26 is substantially perpendicular to the concrete pour 31 thereby maintaining the screed board 30 approximately horizontally perpendicular with the concrete surface area to be leveled. Leveling of the concrete pour 31 is achieved by the operator 34 pulling on handles 42 while walking backwards across the area to be leveled. To obtain a concrete surface that is uniformly even, the screed board ends 44 are placed on top of, and travel along, the screed board guides or form boards 45. To counteract the tendency of the screed board 30 rotating away from the operator 34 (with the pivot point approximately located at the handles 42) due to the weight and high viscosity of the freshly laid concrete pour 31, the operator's forearms 33 are used in conjunction with the curved cuffs 32 to provide a counterforce. Curved cuffs 32 embody herein a support means, rigidly attached to an upper portion of such frame means, for being supported by a user's forearm when such user is grasping such gripping means. Each such curved cuff is structured and arranged, respectively, to overlay a respective one of such user's forearms. This counterforce is transmitted through the substantially vertical frame bars 21 and maintains the screed board 30 in a proper orientation with respect the concrete pour 31 when the manual screeding system 20 is in use. This arrangement embodies in this invention a support means comprising a means for supporting such screeding system from rotation about such gripping means during screeding.

Shown in left side and back elevation in FIGS. 2 and 3 respectively is the preferred embodiment of the present invention substantially shown and described with respect to FIG. 1. Specifically illustrated are the relative dimensions and configurations of the frame-like components comprising the manual screeding system 20 with the preferred dimensions and configurations being hereinafter set forth. The slanted bottom portion 26, formed by a typical metal bending process, is preferably approximately three inches in length. As shown in FIGS. 2 and 5, the slanted bottom portion 26 forms a preferred angle of about approximately ten degrees relative to straight portion 22 as represented by the angle designation Φ. Slanted bottom portion 26 embodies in this invention angle means for normally maintaining such frame means at an angle of about ten degrees toward such user from vertical. Each of the substantially straight portions 22 have a preferred length of approximately 28 inches. Integrally attaching the substantially vertical frame bars 21 are connecting bars 35, each having a preferred length of approximately 23 inches, and having a preferred spacing relative to one another of approximately 23 inches. As shown best in FIG. 2, the curved top portion 24, also formed by a typical metal bending process, has a preferred length of approximately eight inches. The curved top portion 24 is structured and arranged so that the top end 25 of curved top portion 24 protrudes, relative to the straight portion 22, approximately seven inches into the operator area 47 (defined as the space or area in which the operator 34 stands while using the manual screeding system 20 as shown in FIG. 2). In this arrangement, the frame means is embodied by an upwardly-convex curved top portion and wherein such forearm support means is attached to such curved top portion.

Figure 4:
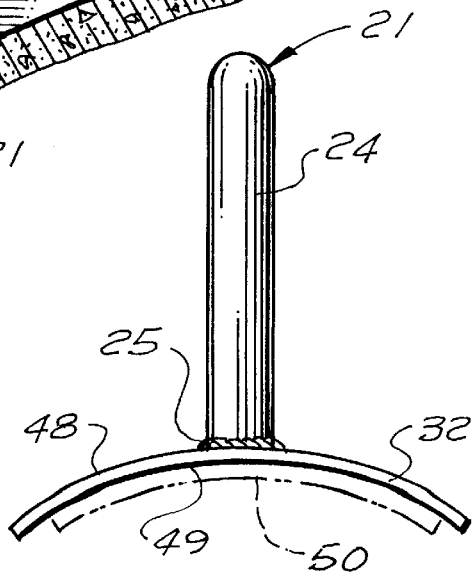
FIG. 4 is a partial top view of the preferred embodiment of FIG. 3 illustrating the arm cuff detail.

Shown in FIG. 4 is a partial top view of FIG. 3 specifically illustrating the preferred configuration of the curved cuffs 32. As shown, the curved cuffs 32, preferably made of 1/16 inch steel and formed by a typical metal bending process, have a convex outer surface 48 and a concave inner surface 49. As shown best in FIG. 3, the curved cuffs 32 are made from a substantially rectangular-shaped piece having preferred dimensions of approximately 4 inches by 6 inches. Attachment of the curved cuffs 32 to the substantially vertical frame bar 21 occurs by integrally attaching, preferably by welding, the convex outer surface 48 of each of the curved cuffs 32 to the top end 25 of the curved top portion 24, as shown. The curved cuffs 32 are oriented for attachment so that the concave inner surface 49 engages the contours of the operator's forearms 33 when the manual screeding system 20 is in use. To add an extra degree of comfort, an alternate preferred embodiment of the present invention incorporates the use of arm cuff pads 50, preferably made of a foam material which is preferably attached by gluing to the concave inner surface 49 of curved cuffs 32 as shown in alternate detail in FIG. 4.

FIG. 5 is a partial enlarged left side elevation view showing the detail of the screed board bracket assembly 37 of the present invention. According to the preferred embodiment of the present invention, the screed board bracket assembly 37 consists of a screed board bracket 38 constructed by securing together, preferably by welding, two pieces of preferably four-inch-long, two-inch-by-⅛-inch-thick, angle iron 51. As shown best in FIG. 5, the pieces of angle iron 51 comprising each screed board bracket 38 are structured and arranged to form a channel section having a substantially open interior portion 55 therein sized to accommodate the thickness of screed board 30 (typically two inches nominal). Screed board brackets 38 embody herein a holding means, rigidly attached to a lower portion of such frame means, for holding a screed board.

To rigidly secure the screed board 30 to each screed board bracket 38, the holding means of the present invention further provides for a pair of tightening bolts 41 (shown best in FIGS. 5 and 6) which, in the preferred embodiment, consist of ½-inch by 1½-inch-long threaded bolts. The front surface 40 of each screed board bracket 38 is provided with a through hole 39 (shown best in FIG. 6) which is necessary to allow each bolt end 56 of tightening bolts 41 to contact the screed board 30 (shown in FIG. 1). To provide a means for allowing each of the tightening bolts 41 to exert a compressive force on the screed board 30, a pair of bolt receivers 57, preferably ½ inch nuts having internal threads, are provided. Tightening bolts 41 embody herein a compressive means for compressively holding such screed board within such respective open interior portions of such brackets. The bolt receivers 57 are securely attached, preferably by welding, to each front surface 40 of each screed board bracket 38, and are structured and arranged for concentric alignment with each through hole 39. To facilitate the turning of each of the tightening bolts 41, a bolt handle 58, having an approximately round cylindrical shape, is attached, preferably by welding, to the bolt head 59 of each of the tightening bolts 41. In the preferred embodiment, each bolt handle 58 is approximately two and three-quarters inches long and is constructed from ⅜-inch steel bar stock.

The method of securing a screed board 30 to each screed board bracket 38 is as follows. A screed board 30 is placed within the interior portion 55 of each screed board bracket 38 so as to maintain an approximate equal distance between each screed board bracket 38 and proximate screed board end 44 as best shown in FIG. 1. A compressive force is then applied to the screed board 30 by either the clockwise or counter-clockwise turning (depending upon whether left or right hand threads are used for each of the tightening bolts 41) of each of the tightening bolts 41, thereby compressively holding the screed board 30 between each bolt end 56 and each interior back surface 60 of each screed board bracket 38.

Although applicant has described applicant's preferred embodiment of this invention, it will be understood that the broadest scope of this invention includes such modifications as diverse shapes, sizes, and materials. Such scope is limited only by the claims as read in connection with the above specification. Further, many other advantages of applicant's invention will be apparent to those skilled in the art from the above descriptions and the below claims.

What is claimed is:

1. A manual screeding system, for use with a concrete screed, operable by a single user and held and supported by the user's hands and forearms, comprising in combination:

a. frame means for providing structural integrity to said screed;

b. holding means, rigidly attached to a lower portion of said frame means, for holding a screed board;

c. gripping means, rigidly attached to an upper portion of said frame means, for being grasped by a user's hand; and d. support means, rigidly attached to an upper portion of said frame means, for being supported by a user's forearm when said user is grasping said gripping means;

e. structured and arranged in such manner that said user may control a pulling of said screed over concrete.

2. A manual screeding system according to claim 1 wherein said support means comprises means for supporting said screeding system from rotation about said gripping means during screeding.

3. A manual screeding system according to claim 2 wherein said support means comprises a pair of curved cuffs, each said curved cuff being structured and arranged, respectively, to overlay a respective one of said user's forearms.

4. A manual screeding system according to claim 3 wherein said curved cuffs are sized and curved in such manner as to engage said forearms of said user.

5. A manual screeding system according to claim 4 wherein said curved cuffs further comprise a padding material.

6. A manual screeding system according to claim 1 wherein said gripping means comprises a pair of handles.

7. A manual screeding system according to claim 6 wherein each said handle comprises a substantially straight bar member.

8. A manual screeding system according to claim 1 wherein said frame means comprises an upwardly-convex curved top portion and wherein said forearm support means is attached to said curved top portion.

9. A manual screeding system according to claim 1 further comprising angle means for normally maintaining said frame means at an angle of about ten degrees toward said user from vertical.

10. A manual screeding system according to claim 1 wherein:

a. said forearm support means comprises a pair of curved cuffs, each said curved cuff being structured and arranged, respectively, to overlay a respective one of said user's forearms;

b. said gripping means comprises a pair of handles;

c. said frame means comprises an upwardly-convex curved top portion; and d. said forearm support means is attached to said curved top portion.

11. A manual screeding system for use with a screed board, operable by a single user, and having a user side and an exterior side, and held and supported by the user's hands and forearms, comprising in combination:

a. a pair of substantially vertical frame bars each having i. an intermediate substantially straight portion, having an upper end, ii. an upwardly-convex curved top portion, curving toward the user side from said upper end of said straight portion, and having a user-side end portion, and iii. a bottom portion, angled toward the user side, having a bottom end;

b. a first substantially horizontal frame bar, attached to each of said substantially vertical frame bars;

c. a second substantially horizontal frame bar, spaced apart from said first substantially horizontal frame bar and attached to each of said substantially vertical frame bars;

d. a gripping means, attached to each said upper end of each said straight portion, for manually holding and manipulating said screeding system during screeding;

e. a holding means, attached to said bottom end of said bottom portion, for holding said screed board to said screeding system; and f. a support means, attached to each said user-side end portion, for supporting said screeding system from rotation about said gripping means during screeding.

12. A manual screeding system according to claim 11 wherein said bottom portion is angled toward the said user side at an angle of about ten degrees.

13. A manual screeding system according to claim 12 wherein said holding means comprises a pair of brackets, each said bracket having a substantially open interior portion structured and arranged for receipt of said screed board.

14. A manual screeding system according to claim 13 wherein said holding means further comprises a compressive means for compressively holding said screed board within said respective open interior portions of said brackets.

15. A manual screeding system according to claim 14 wherein said compressive means comprises a threaded bolt.

16. A manual screeding system according to claim 11 wherein each said support means comprises a curved cuff structured and arranged for overlaying a user's forearm.

17. A manual screeding system according to claim 16 wherein:

a. said holding means comprises a pair of brackets, each said bracket having a substantially open interior portion structured and arranged for receipt of said screed board; and b. each said gripping means comprises a pair of substantially straight, substantially horizontal, bar members.

18. A manual screeding system according to claim 17 wherein:

a. each said curved cuff further comprises a padding material.

19. A manual screeding system according to claim 17 wherein:

a. each said bar member is covered with a bicycle-handle-type grip.

20. A manual screeding system according to claim 11 wherein each said gripping means comprises a pair of substantially straight, substantially horizontal, bar members.

* * * * *